US006955307B2

(12) United States Patent
Carlisle et al.

(10) Patent No.: US 6,955,307 B2
(45) Date of Patent: Oct. 18, 2005

(54) DEPOSIT CONTROL IN FUEL INJECTOR NOZZLES

(75) Inventors: Hugh William Carlisle, Sorrento (AU); Robert Walter Frew, Scarborough (AU); Geoffrey Paul Cathcart, Yokine (AU)

(73) Assignee: Orbital Engine Company (Australia) Pty Limited, Balcatta (AU)

( * ) Notice: Subject to any disclaimer, the term of this patent is extended or adjusted under 35 U.S.C. 154(b) by 155 days.

(21) Appl. No.: 10/257,386

(22) PCT Filed: Apr. 20, 2001

(86) PCT No.: PCT/AU01/00460

§ 371 (c)(1),
(2), (4) Date: May 12, 2003

(87) PCT Pub. No.: WO01/81758

PCT Pub. Date: Nov. 1, 2001

(65) Prior Publication Data

US 2003/0173425 A1 Sep. 18, 2003

(30) Foreign Application Priority Data

Apr. 20, 2000 (AU) ..... PQ7082

(51) Int. Cl.[7] ..... F02M 61/00; F02M 59/00; B05B 1/30

(52) U.S. Cl. ..... 239/533.12; 239/533.7; 239/533.2; 239/585.1; 239/585.5; 239/88

(58) Field of Search ..... 239/533.12, 533.7, 239/533.9, 533.2, 533.3, 585.1–585.5, 88–93; 251/129.15, 129.21, 127

(56) References Cited

U.S. PATENT DOCUMENTS

| | | | | |
|---|---|---|---|---|
| 2,874,000 A * | 2/1959 | Nystrom | 239/584 |
| 3,531,052 A * | 9/1970 | Berlyn | 239/533.7 |
| 3,690,566 A * | 9/1972 | Krauss et al. | 239/453 |
| 4,993,643 A | 2/1991 | Schechter et al. | |
| 5,685,492 A | 11/1997 | Davis | |
| 6,168,132 B1 * | 1/2001 | Frank et al. | 251/33 |

FOREIGN PATENT DOCUMENTS

| | | |
|---|---|---|
| EP | 0 363 162 | 4/1990 |
| JP | 08-277765 | 10/1996 |
| JP | 08-338343 | 12/1996 |
| WO | WO 91/11609 A1 | 8/1991 |
| WO | WO 01 77518 A1 | 10/2001 |

OTHER PUBLICATIONS

Injector Nozzle- Kurt Tobler pp. 1 of 2. Derwent Abstract Accession No. 97-104320/10, Class Q53, JP 08338343A (ZEXEL KK) Dec. 24, 1996.

* cited by examiner

*Primary Examiner*—Davis Hwu
(74) *Attorney, Agent, or Firm*—Rothwell Figg Ernst & Manbeck

(57) ABSTRACT

An injector nozzle for a fuel injected internal combustion engine, said injector nozzle including a port (5) having an internal valve seat surface (15) and a valve member (13) having an external seating surface (17), said valve member being movable relative to the port to respectively provide a passage between the valve seat surface and the external seating surface for the delivery of fuel therethrough or sealed contact therebetween to prevent said delivery of fuel, the port further including an outer port surface (16) surrounding and located adjacent the valve seat surface and external to the port, wherein the angle between the valve seat surface and the outer port surface of the port is less than 90 degrees.

25 Claims, 2 Drawing Sheets

DEPOSIT CONTROL IN FUEL INJECTOR NOZZLES

Figure 1:
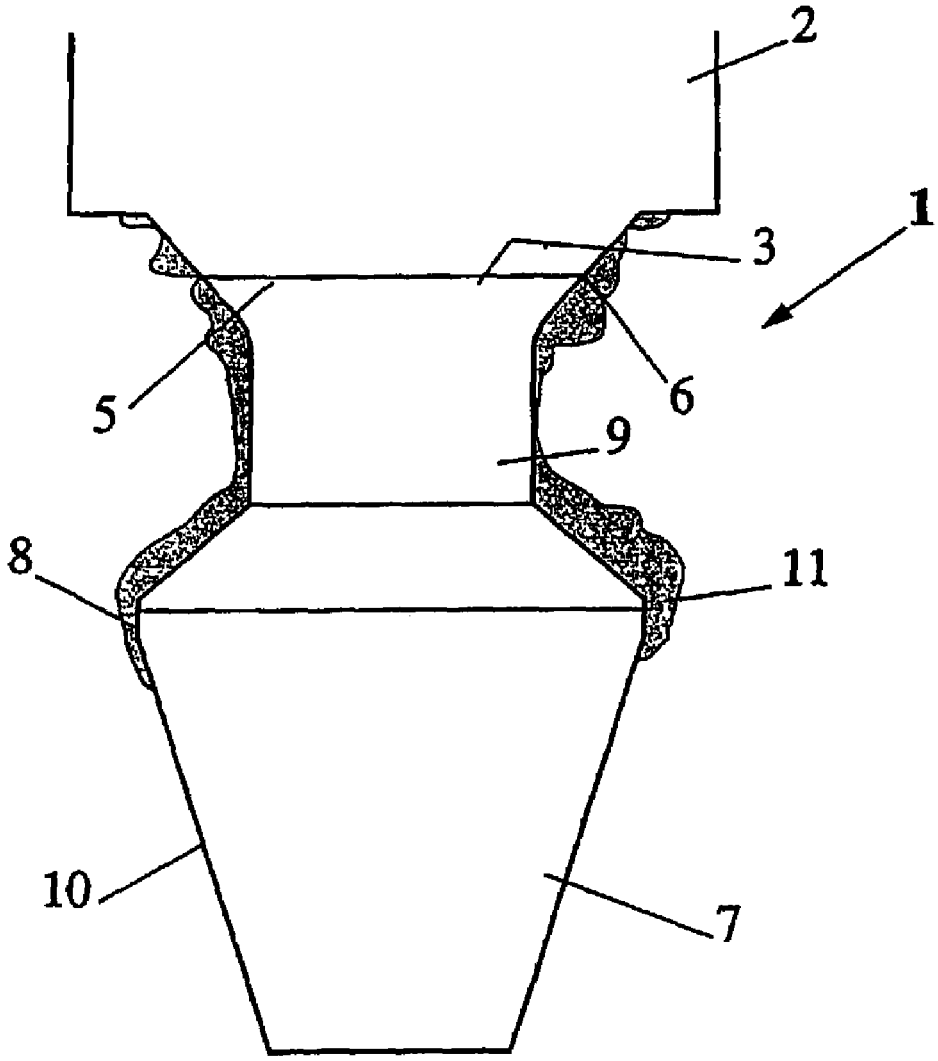

The present invention is generally directed to fuel injector nozzles of the outwardly opening poppet valve type, and in particular to the control of carbon deposits which may form on such injector nozzles.

Such injector nozzles typically deliver fuel in the form of a cylindrical or divergent conical spray. The nature of the shape of the fuel spray is generally dependent on a number of factors including, amongst other things, the geometry of the port and valve member constituting the nozzle, especially the surfaces of the port and valve member immediately adjacent the valve seat, where the port and valve engage to seal when the nozzle is closed to prevent the delivery of fuel therethrough. Once a nozzle geometry has been selected to give a required performance from the injector nozzle and hence the engine combustion system, relatively minor departures from that geometry can significantly impair the fuel delivery and combustion performance, particularly at low fuelling rates.

The attachment or build-up of solid combustion products or other deposits on the nozzle surfaces over which the fuel flows can be detrimental to the shape of the issuing fuel spray, the creation of the correct fuel distribution and hence the subsequent combustion process within the engine. The same can be said of deposit formation on the port and valve member terminal surfaces immediately adjacent the nozzle exit through which fuel is delivered. The principal cause of build-up on these surfaces is the adhesion thereto of carbon related or other particles that are produced by the combustion of fuel within the combustion chamber of the engine, including incomplete combustion of residual fuel which may remain on these surfaces between injection or combustion cycles.

It is known that a hollow fuel plume issuing from a nozzle initially follows a path principally determined by the exit direction and exit velocity of the fuel. It is also known that as the fuel plume advances beyond the delivery end of the injector nozzle that the reduction in the velocity of the fuel plume and the generally low pressure existing within the area bound by the plume immediately downstream of the nozzle promotes some inward contraction of the plume, often referred to as necking. In certain engine applications, this necking of the fuel plume provides certain advantages, particularly in regard to the desired containment of the fuel spray within the combustion chamber.

It has been found that disturbances to the fuel flow from the nozzle can significantly influence the shape and distribution of the fuel plume within the combustion chamber, particularly during and subsequent to the necking thereof. Such influences can promote unpredictable deflection and/or dispersion of the fuel, which in turn can adversely affect the combustion process and thus give rise to an increase in fuel consumption, undesirable levels of exhaust emissions, and also instability in engine operation, particularly at low load operation. Disturbances that can give rise to such undesirable influences or detrimental effects include the presence of irregular deposits on the surfaces defining the injector nozzle exit, such as carbonaceous and other combustion related deposits, eccentricity of the valve member and valve seat components of the nozzle, and/or excessive clearance between the stem of the valve member and the bore in which it axially moves as it opens and closes. Lateral movement or eccentricity of the valve member and deposits on the valve member or valve seat can each result in changes in the relative rate of flow over different sections of the periphery of the nozzle thus causing an asymmetric fuel plume.

The above discussed disturbances to the delivery of fuel to the combustion chamber of an engine are particularly significant in engines which, for at least part of engine load range, operate with a highly stratified fuel charge such as is recognised as highly desirable to control exhaust emissions, particularly during low load operation. An example of such a stratified charge engine is one employing a dual fluid fuel injection system such as that disclosed in the Applicant's U.S. Pat. Nos. 4,693,224 and RE 36768, the contents of which are included herein by way of reference. In such a fuel injection system, individual metered quantities of fuel are delivered to the or each engine combustion chamber entrained in a quantity of gas, typically compressed air.

One way of improving the control of the shape and distribution of the fuel plume within the combustion chamber, and thereby the performance and efficiency of the injector nozzle, is by providing a projection extending beyond an extremity of the injector nozzle. Such an arrangement is for example described in the Applicants' U.S. Pat. Nos. 5,551,638 and 5,833,142, the details of which are incorporated herein by reference. The projection is configured and positioned such that the fuel plume issuing from the nozzle exit when the injector nozzle is open will embrace a portion of the projection adjacent the valve member and subsequently follow a path determined by the external surface of the projection.

Conveniently, the projection has a circular cross-section and preferably converges from a point along the projection towards the end thereof remote from the valve member. Conveniently, a necked portion provided between the valve member and the adjacent end of the projection provides a reduced cross-sectional area to thereby reduce the area through which heat in the projection can flow to the valve member and hence be dissipated through the injector nozzle and to the engine cylinder or cylinder head. This feature, together with other aspects of the projection, contributes to the retainment of heat in the projection to thereby maintain the projection at a sufficiently high temperature to burn off or prevent the formation of any carbon or other deposits on the surface thereof.

Nonetheless, it has been found that in certain engine applications there may still occur some build-up of carbon deposits immediately adjacent the nozzle exit and on certain surfaces of the projection itself. This formation of carbon deposits at the injector nozzle exit surfaces has the ability to disrupt the injected spray plume thus altering the fuel spray characteristics within the combustion chamber. This may, as alluded to above, have a detrimental impact on combustion stability, smoke levels, fuel consumption and engine out emission levels, all which may ultimately lead to poor vehicle driveability and/or the inability to meet prescribed emissions or fuel economy targets.

It is therefore an object of the present invention to provide an improved poppet valve type injector nozzle that will minimise carbon build-up and the formation of deposits on the injector nozzle.

With this in mind, there is provided, an injector nozzle for a fuel injected internal combustion engine, said injector nozzle including a port having an internal valve seat surface and a valve member having an external seating surface, said valve member being movable relative to the port to respectively provide a passage between the valve seat surface and the external seating surface for the delivery of fuel therethrough or sealed contact therebetween to prevent said delivery of fuel, the port further including an outer port surface surrounding and located adjacent the valve seat surface and external to the port, herein the angle between the valve seat surface and the outer port surface of the port is less than 90 degrees and configured so as to control the formation of deposits at or adjacent an exit of the nozzle passage.

The valve member may have an outer valve surface located adjacent to the external seating surface, and the angle between the external seating surface and the outer valve surface of the valve member may also be preferably less than 90 degrees.

Conveniently, the acute angle between the valve seat surface and the outer port surface and/or the acute angle between the external seating surface and the outer valve surface are configured so as to control the formation of deposits at or adjacent an exit of the nozzle passage.

Preferably, the angle between the outer valve surface and the outer port surface is of the order of 90 degrees.

Conveniently, the injector nozzle is of the outwardly opening poppet valve type. However, the present invention may also have applicability to certain designs of inwardly opening pintle valve arrangements.

Preferably, the injector nozzle is arranged to deliver fuel directly into a combustion chamber of the engine. However, whilst the present invention may have particular applicability to direct fuel injection systems, it is also applicable to other types of fuel systems such as manifold or port injection type systems.

The internal valve seat surface of the port and the external seating surface of the valve member may together dictate the exit trajectory or direction of a fuel spray as it is delivered from the injector nozzle. Generally, this exit trajectory will follow an imaginary extension of the passage between the valve seat surface and the external seating surface and more particularly the direction of the passage nearest the outermost extremity of the injector nozzle. Conveniently, the exit trajectory of the fuel spray is acutely angled with respect to the longitudinal axis of the injector nozzle. That is, the exit trajectory of the fuel spray will in general vary axially from the direction of movement of the valve member by an angle of less than 90 degrees. Conveniently, the exit trajectory will be axially angled with respect to the direction of movement of the valve member by about 45 degrees.

Preferably, the angle between the exit trajectory of the fuel spray and the outer port surface of the port is greater than 90 degrees. Preferably, the angle between the exit trajectory of the fuel spray beyond an extremity of the nozzle and the outer valve surface of the valve member is also greater than 90 degrees.

The angle between the valve seat surface and the outer port surface of the port may conveniently be about 45 degrees. Furthermore, the angle between the external seating surface and the outer valve surface of the valve member may also be about 45 degrees. Put another way, the angle between the fuel exit trajectory and the outer port surface of the port may conveniently be about 135 degrees. Further, the angle between the fuel exit trajectory and the outer valve surface of the valve member may also conveniently be about 135 degrees.

Conveniently, the outer port surface may be arranged to be parallel with the axial direction of movement of the valve member. That is, the outer port surface may conveniently be parallel with the longitudinal axis of the injector nozzle. Conveniently, the outer valve surface may be arranged normal to the axial direction of movement of the valve member. That is, the outer valve surface may conveniently be normal to the longitudinal axis of the injector nozzle.

A sharp edge may be provided at the transition between the seating surface and the outer valve surface of the valve member. A sharp edge may also be provided at the transition between the valve seat surface and the outer port surface. In both of these scenarios, the sharp edge is defined by the acute angle existing between the seating surface and the outer valve surface and correspondingly between the valve seat surface and the outer port surface. Accordingly, in designs where the sharp edge is provided by an acutely angled exit portion, no port or valve member exit surfaces exist which are normal to the fuel exit trajectory.

A narrow intermediate surface may alternatively be provided separating the seating surface and the outer valve surface of the valve member, with a sharp edge being provided at the transition between the intermediate surface and the seating surface. A narrow intermediate surface separating the valve seat surface and the outer port surface of the port may also or alternatively be provided, with a sharp edge being provided at the transition between the intermediate surface and the valve seat surface. These intermediate surfaces of the valve member and the valve port may be at least substantially located in a common plane when the valve member is fully seated in the port. Conveniently, these intermediate or exit surfaces of the valve member and valve port may be arranged to be normal to the fuel exit trajectory. Alternatively, the angle between the intermediate surfaces and the valve seat surface and external seating surface may be less than or equal to 90 degrees.

In all of the above arrangements, the sharp edge may be achieved by lapping or grinding one or both of the surfaces to thereby achieve a sharp edge transition therebetween.

The valve member may include a projection extending beyond the extremity of the nozzle for controlling the shape of the fuel spray or plume issuing from the nozzle. The projection may be any one of the types discussed in the Applicant's U.S. Pat. Nos. 5,551,638 and 5,833,142. Further, the projection may be one according to any of the designs discussed in the Applicant's Co-pending Patent Application No. PCT/AU01/00382 filed on Apr. 5, 2001. Alternatively, the projection may be of any other configuration suitable to control the shape of the fuel plume.

The present invention may be used on injector valves where the valve member is heel seated within the port. It is however also possible for the present invention to be used on injector valves where the valve member is toe seated within the port. In this connection, the distinction between heel and toe seated relates to the location of the seat-line between the valve member and the port. For example, toe seated equates to the scenario where the seat-line is closer to the outermost extremity of the nozzle.

Preferably, any sharp edges on the valve member and port are located immediately adjacent each other when the valve member is seated in the port to prevent fuel flow through the noble passage. In such an arrangement, the seat-line between the valve member and the port may be located upstream of the exit of the nozzle passage and within said passage such that a narrow gap exists downstream of the seat-line, said narrow gap terminating at the sharp edges. Alternatively, the seat-line may be provided at or immediately adjacent the sharp edges such that the sharp edges are arranged to contact when the valve member is seated within the port.

Conveniently, the gap between the seating surface and the valve seat surface where the valve member is seated within the port may be minimised to be less than a predetermined width so as to further restrict the formation of any deposits within the nozzle passage. In this connection, the width of the gap may correspond to that as described in either of the Applicant's U.S. Pat. Nos. 5,593,095 and 5,685,492, the contents of which are included herein by way of reference.

The injector nozzle of the present invention has application to both single fluid and dual fluid fuel injection systems for a variety of engine applications. The injector nozzle does however have particular applicability to dual fluid fuel systems where metered quantities of fuel are delivered to the engine entrained in compressed air. In such fuel systems, the fuel issuing from the injector nozzle typically does so in the form of a spray or cloud of fuel droplets and vapour. The trajectory of the fuel spray, which is delivered by way of comparatively low pressure compressed air, is influenced by the nozzle exit surfaces and/or any projection or flow control means located downstream of the injector nozzle to influence the shape and distribution of the fuel plume within the combustion chamber. Such dual fluid systems are disclosed for example in the Applicant's U.S. Pat. Nos. 4,693,224, 4,934,329 and RE 36768, the contents of which are incorporated herein by way of reference.

The geometry about the nozzle passage exit described above provides for a "cutback" or relief on the valve member and on the external surfaces surrounding the port adjacent the nozzle passage exit. These cutback surfaces create an acutely angled nozzle exit surface on each of the valve member and port which essentially define deposit breaking edges or portions. These deposit breaking edges are situated immediately adjacent to the nozzle passage exit and thus any deposits which may form on these edges are likely to be dislodged by the shearing effect of the fuel issuing from the nozzle passage exit. That is, any deposits which may form at a point immediately adjacent the nozzle passage exit and on the deposit breaking edges are likely to have a very low resistance to shearing type forces. Hence, the flow of fuel alongside and across such deposits will typically result in the deposits closest to the nozzles passage exit being, broken away. Thus, the presence of the cutback surfaces facilitates the control of deposit build-up on the exit surfaces of the port and valve member by the physical mechanism of deposit shear.

In addition, the cutback surfaces are angled such that any deposit build-up that may occur, which is typically normal to the surface, does so in a direction away from the nozzle passage exit thereby minimising the influence of the deposit on the spray geometry of the fuel plume exiting the injector nozzle. That is, the outer port surface of the port and the outer valve surface of the valve member are arranged such that any deposit build-up which may occur on these surfaces extends in a direction away from the fuel exit trajectory so as to minimise any effect on the fuel spray delivered into the combustion chamber of the engine.

Furthermore, the additional provision of sharp edges on the exit surfaces of the valve member and preferably also on the port facilitates the maintenance of an optimal nozzle exit spray geometry preventing over expansion of the fuel plume at the nozzle passage exit and thereby reducing droplet impingement on the outer surfaces of the nozzle leading to improved deposit control. Furthermore, the sharp edges act as deposit breaking edges adjacent to the nozzle passage exit thus controlling deposit build-up at the nozzle passage exit by the physical mechanism of deposit shear and/or the mechanical opening and closing action of the valve member within the port which may serve to dislodge any deposits at or adjacent the exit of the nozzle passage.

It will be convenient to further describe the invention with respect to the accompanying drawings which illustrate preferred embodiments of a fuel injector nozzle according to the present invention. Other embodiments of the invention are however also possible, and consequently, the particularity of the accompanying drawings is not to be understood as superseding the generality of the preceding description of the invention.

Figure 2A:
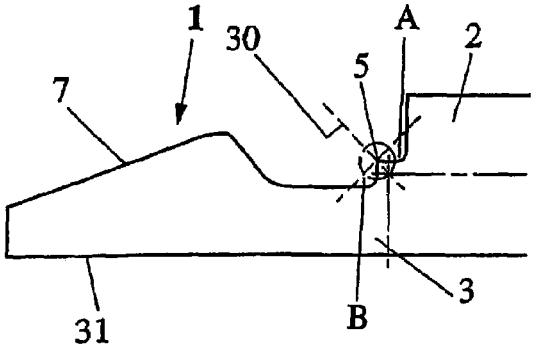
Figure 2B:
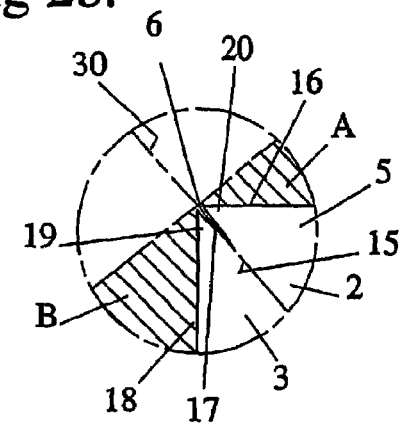
Figure 3A:
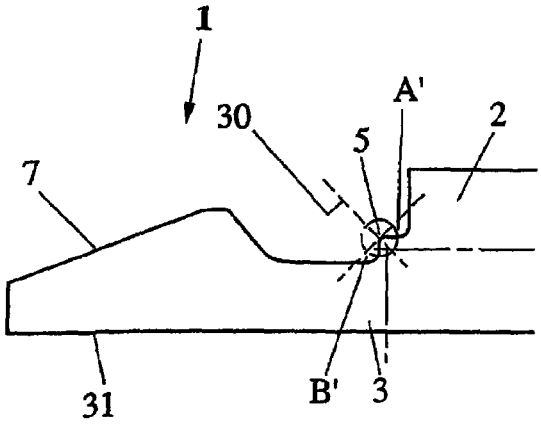
Figure 3B:
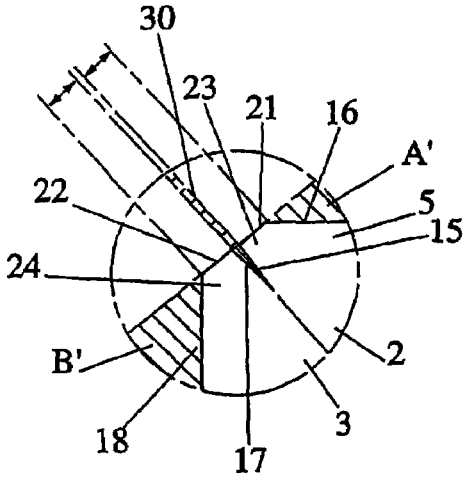

In the drawings:

FIG. 1 is a schematic side view of the nozzle section of a prior art fuel injector nozzle;

FIGS. 2*a* and 2*b* are respectively schematic and detail views showing the nozzle geometry of a first preferred embodiment of the injector nozzle according to the present invention; and FIGS. 3*a* and 3*b* are respectively schematic and detail views showing the nozzle geometry of a second preferred embodiment of an injector nozzle according to the present invention.

FIG. 1 is a schematic view showing the nozzle geometry of a known poppet valve type fuel injector nozzle 1. This injector nozzle 1 includes a nozzle body 2 supporting a valve member 3 with a port 5 being provided at a lower extremity of the nozzle body 2. A nozzle passage 6 is provided between the port 5 and the valve member 3 when the valve member 3 is in an open position and sealing engagement exists between the port 5 and the valve member 3 when the valve member 3 is in a closed position.

The valve member 3 includes a fuel plume guide projection 7 dependent from and connected thereto by a necked-in portion 9. The projection 7 has a maximum diameter 8 which is selected so that the fuel plume issuing from the exit point of the nozzle passage 6 when the valve member 3 is in an open position will follow a path based on the external surface 10 of the projection 7. The injector nozzle 1 is typically arranged to deliver fuel directly into the combustion chamber of an engine and so the lower portion thereof is exposed to the pressures, temperatures and combustion gases which exist within the engine combustion chamber during engine operation.

FIG. 1 also schematically shows the type of carbon deposit formation 11 that may occur on the injector nozzle 1 after prolonged use of the injector nozzle 1. This carbon formation 11 can accumulate adjacent the exit of the nozzle passage 6 and on the projection 7 and necked-in portion 9. This carbon formation 11 can potentially seriously affect the efficiency and performance of the injector nozzle as described previously. More particularly, the deposits which may build-up adjacent the nozzle exit surfaces defined by the port 5 and valve member 3 can impede the fuel spray issuing from the nozzle passage 6 and hence effect the shape and distribution of the resulting spray plume into the combustion chamber.

FIGS. 2*a* and 2*b* are schematic views showing the nozzle geometry of a first preferred embodiment of the injector nozzle according to the present invention. It should be noted that the same reference numerals are used on corresponding components of the injector nozzle for clarity purposes.

The injector nozzle 1 includes a nozzle body 2 and a valve member 3 having a projection 7 dependent therefrom as in the injector nozzle shown in FIG. 1. FIG. 2*b* shows in more detail the nozzle geometry according to the present invention immediately adjacent the exit of the nozzle passage 6. The port 5 of the nozzle body 2 has an internal valve seat surface 15 upon which the valve member 3 is seated when in the closed position. The valve member 3 therefore includes an external seating surface 17 which cooperates with the valve seat surface 15 of the port 5. The nozzle passage 6 is provided between the valve seat surface 15 of the port 5 and the seating surface 17 of the valve member 3 when the nozzle is open.

The port 5 further includes an outer port surface 16 surrounding and located adjacent to the valve seat surface 15. According to the present invention, the angle between the valve seat surface 15 and the outer port surface 16 of the port 5 may be less than 90 degrees, preferably about 45 degrees. Furthermore, the valve member 3 includes an outer valve surface 18 located adjacent to the seating surface 17 of the valve member 3. According to the present invention, the angle between the seating surface 17 and the outer valve surface 18 of the valve member 3 may also be less than 90 degrees, preferably about 45 degrees. Hence, as can be seen in FIG. 2*b*, the angle between the outer port surface 16 and the outer valve surface 18 may be of the order of 90 degrees.

The exit trajectory of fuel issuing from the injector nozzle 1 will typically initially follow a path as dictated by the direction of the nozzle passage 6. In this regard, the fuel exit trajectory would be in the direction as shown by the dashed line 30. In this particular embodiment, the fuel exit trajectory 30 is substantially planar with each of the valve seat surface 15 and seating surface 17. According to the present invention, the angle between the fuel exit trajectory 30 and the outer port surface 16 of the port 5 may be greater than 90 degrees, and preferably about 135 degrees. Further, the angle between the fuel exit trajectory 30 and the outer valve surface 18 of the valve member 3 is also typically greater than 90 degrees and preferably about 135 degrees.

Still further, in the present embodiment it is evident that the outer port surface 16 is essentially parallel to the axis of the injector nozzle 1 as indicated by the line 31. Further, the outer valve surface 18 as shown in the present embodiment is essentially normal to the axis of the injector nozzle 1 as indicated by the line 31.

This arrangement provides a "cut-back" geometry or relief about the exit of the nozzle passage 6 which acts to create an acute exit portion on each of the valve member 3 and port 5. The nature and extent of this cutback or relief can be more clearly appreciated from a consideration of the areas A and B shown in FIGS. 2*a* and 2*b*. A comparison with the same region of the injector nozzle 1 of FIG. 1 highlights the extent to which the nozzle exit portion and surfaces have been modified with the areas A and B indicating material that would otherwise have been present at the port 5 and valve member 3 adjacent the exit of the nozzle passage 6.

This arrangement essentially facilitates a deposit breaking edge adjacent to the exit of the nozzle passage 6 which assists in controlling deposit build-up by the physical mechanism of deposit shear as discussed hereinbefore. Furthermore, the outer port surface 16 and the outer valve surface 18 are angled to the fuel exit trajectory 30 such that any deposit build-up that may occur thereon, which is typically normal to the surface, does so in a direction away from the exit trajectory 30 and the exit of the nozzle passage 6, thereby minimising the influence of any such deposits on the spray geometry of the fuel plume exiting the nozzle passage 6.

Furthermore, a sharp edge 19 may also be provided at the transition between the seating surface 17 and the outer valve surface 18 of the valve member 3. A sharp edge 20 may also be provided at the transition between the valve seat surface 15 and the outer port surface 16 of the port 5. The effect of the sharp edges 19, 20 is to prevent any over expansion of the fuel plume at the exit of the nozzle passage 6 and thereby reduce droplet impingement on the exit surfaces of the nozzle in turn leading to improved deposit control. Furthermore, the sharp edges 19, 20 act as deposit breaking edges adjacent to the exit of the nozzle passage 6 thus controlling deposit build-up at the exit to this nozzle passage 6 by the physical mechanism of deposit shear or dislodgment as alluded to hereinbefore.

FIGS. 3*a* and 3*b* show an alternative preferred embodiment of an injector nozzle according to the present invention. The main difference with the embodiment shown in FIGS. 2*a* and 2*b* is that an intermediate surface 21 is provided between the valve seat surface 15 and the outer port surface 16 of the port 5. Furthermore, an intermediate surface 22 can also be provided between the seating surface 17 and the outer valve surface 18 of the valve member 3. The intermediate surfaces 21, 22 may have a width of 0.1 mm. A sharp edge 23 can in this case be provided between the transition of the intermediate surface 21 of the port 5 and the valve seat surface 15. Furthermore, a sharp edge 24 can also be provided between the intermediate surface 22 of the valve member 3 and the seating surface 17.

In the embodiment shown in FIGS. 3*a* and 3*b*, the sharp edges 23, 24 are shown as being of the order of 90 degrees, however it is to be appreciated that an acute angle may be provided at one or both of the edges 23, 24 depending on the particular application.

The intermediate surfaces 21, 22 may be substantially normal to the fuel exit trajectory 30. Furthermore, the intermediate surfaces 21, 22 may be arranged in the same plane. The arrangement shown in FIGS. 3*a* and 3*b* still provides a majority of the deposit control features as discussed hereinbefore, but in certain cases, may be somewhat more convenient to manufacture than the arrangement shown in FIGS. 2*a* and 2*b*. The extent and nature of the cutbacks to the port 5 and valve member 3 can in regard to this embodiment be ascertained from a consideration of the regions A1 and B1.

The injector nozzle of the present invention has application to both single and dual fluid injection systems and may be adapted for use together with any other deposit control concepts. For example, the features of the injector nozzle may be combined with aspects relating to flow control, temperature control, surface finish and material selection. The injector nozzle of the present invention has applicability to direct injected engines and particularly those operating with a stratified fuel distribution at some point of the engine operating load range. Furthermore, although the present invention has been described with respect to injector nozzles incorporating a flow control projection, it is to be appreciated that the present invention is equally applicable for injector nozzles that do not incorporate such projections.

By minimising the formation of deposits at and adjacent to the exit of the nozzle passage 6, the present invention is able to facilitate a more reliable and repeatable fuel spray delivery from the port 5.

Variations as would be deemed obvious to the person skilled in the art are included within the ambit of the present invention as defined in the appended claims. For example, the valve seat surface 15 or the external seating surface 17 may comprise a curved or spherical profile rather than a flat or conical profile. In such a scenario, the angle between that part of the surface closest to the extremity of the nozzle injector 1 and the outer port surface 16 or outer valve surface 18 as may be appropriate would be less than 90 degrees.

A further variation may involve the provision of a shift radius at the transition between the outer port surface 16 and the valve seat surface 15 and/or the transition between the external seating surface 17 and the outer valve surface 18 rather than a sharp edge. In such a variation, the angle between the surfaces 15, 16 and/or the surfaces 17, 18 would still be arranged to be less than 90 degrees so as to provide a cut-back geometry or relief about the exit of the nozzle passage 6 to thereby minimise the effect of any deposits which may form in the region on the fuel spray issuing from the nozzle.

What is claimed is:

1. An injector nozzle for a fuel injected internal combustion engine, said injector nozzle including a port having an internal valve seat surface and a valve member having an external seating surface, said valve member being movable relative to the port to respectively provide a passage between the valve seat surface and the external seating surface for the delivery of fuel therethrough or sealed contact therebetween to prevent said delivery of fuel, the port further including an outer port surface surrounding and located adjacent the valve seat surface and external to the port, wherein the angle between the valve seat surface and the outer port surface of the port is less than 90 degrees and configured so as to control the formation of deposits at or adjacent an exit of the nozzle passage.

2. An injector nozzle according claim 1, wherein the valve member has an outer valve surface located adjacent to the external seating surface and the angle between the external seating surface and the outer valve surface of the valve member is less than 90 degrees.

3. An injector nozzle according to claim 2, wherein the acute angle between the valve seat surface and the outer port surface and/or the acute angle between the external seating surface and the outer valve surface are configured so as to control the formation of deposits at or adjacent an exit of the nozzle passage.

4. An injector nozzle according to claim 2, wherein the angle between the outer valve surface and the outer port surface is of order of 90 degrees.

5. An injector nozzle according to claim 2, wherein the angle between the exit trajectory of the fuel spray and the outer valve surface of the valve member is greater than 90 degrees.

6. An injector nozzle according to claim 2, wherein the angle between the valve seat surface and the outer port surface of the port is about 45 degrees.

7. An injector nozzle according to claim 2, wherein the angle between the external seating surface and the outer valve surface of the valve member is about 45 degrees.

8. An injector nozzle according to claim 2, wherein a sharp edge is provided at the transition between the seating surface and the outer valve surface of the valve member.

9. An injector nozzle according to claim 2, wherein a sharp edge is provided at the transition between the seating surface and the outer valve surface of the valve member.

10. An injector nozzle according to claim 2, wherein a narrow intermediate surface is provided separating the seating surface and the outer valve surface of the valve member, with a sharp edge being provided at the transition between the intermediate surface and the seating surface.

11. An injector nozzle according to claim 1, wherein the internal valve seat surface of the port and the external seating surface of the valve member together dictating the exit trajectory of a fuel spray as it is delivered from the injector nozzle, the exit trajectory generally following an imaginary extension of the passage between the valve seat surface and the external seating surface, wherein the exit trajectory of the fuel spray is acutely angled with respect to the longitudinal axis of the injector nozzle.

12. An injector nozzle according to claim 11, wherein the exit trajectory is axially angled with respect to the direction of movement of the valve member by about 45 degrees.

13. An injector nozzle according to claim 11, wherein the angle between the exit trajectory of the fuel spray and the outer port surface of the port is greater than 90 degrees.

14. An injector nozzle according to claim 1, wherein the outer port surface is arranged to be parallel with the axial direction of movement of the valve member.

15. An injector nozzle according to claim 1, wherein a sharp edge is provided at the transition between the valve seat surface and the outer port surface.

16. An injector nozzle according to claim 1, wherein narrow intermediate surface separating the valve seat surface and the outer port surface of the port is provided, with a sharp edge being provided at the transition between the intermediate surface and the valve seat surface.

17. An injector nozzle according to claim 16, wherein the intermediate surfaces of the valve member and the valve port are at least substantially located in a common plane when the valve member is fully seated in the port.

18. An injector nozzle according to claim 16, wherein the intermediate or exit surfaces of the valve member and valve port are arranged to be normal to the fuel exit trajectory.

19. An injector nozzle according to claim 16, wherein the angle between the intermediate surfaces and the valve seat surface and external seating surface is less than or equal to 90 degrees.

20. An injector nozzle according to claim 1, the nozzle being of the outwardly opening poppet valve type.

21. An injector nozzle according to claim 1, the nozzle being arranged to deliver fuel directly into a combustion chamber of the engine.

22. An injector nozzle according to claim 1, wherein a projection is arranged beyond the extremity of the nozzle for controlling the shape of the fuel spray issuing form the nozzle.

23. An injector nozzle according to claim 22, wherein the sharp edges on the valve member and on the port facilitate the maintenance of an optimal nozzle exit spray geometry thereby preventing over expansion of the fuel spray at the exit of the nozzle passage.

24. An injector nozzle according to claim 1, wherein the nozzle comprises a dual fluid fuel injection nozzle.

25. An injector nozzle for a fuel injected internal combustion engine, said injector nozzle including a port having an internal valve seat surface and a valve member having an external seating surface, and an outer valve surface located adjacent to the external seating surface, said valve member being movable relative to the port to respectively provide a passage between the valve seat surface and the external seating surface for the delivery of fuel therethrough or sealed contact therebetween to prevent said delivery of fuel, the valve member further including an outer valve surface located adjacent to the external seating surface, wherein the angle between the external seating surface and the outer valve surface of the of the valve member is less than 90 degrees, and configured so as to control the formation of deposits at or adjacent an exit of the nozzle passage.

* * * * *